US007435126B1

(12) United States Patent
Larkin

(10) Patent No.: US 7,435,126 B1
(45) **Date of Patent: *Oct. 14, 2008**

(54) SNAGLESS PLUG AND BOOT CONNECTION

(75) Inventor: Kevin Larkin, Pebble Beach, CA (US)

(73) Assignee: Westek Electronics, Inc., Santa Cruz, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/796,334

(22) Filed: Apr. 27, 2007

Related U.S. Application Data

(60) Provisional application No. 60/922,101, filed on Apr. 6, 2007.

(51) Int. Cl.
*H01R 13/627* (2006.01)

(52) U.S. Cl. ..... 439/352

(58) Field of Classification Search ..... 439/344, 439/352, 345–347, 354

See application file for complete search history.

(56) References Cited

U.S. PATENT DOCUMENTS

| | | | | |
|---|---|---|---|---|
| 5,334,044 | A | 8/1994 | Falossi et al. | 439/491 |
| 5,462,457 | A | 10/1995 | Schroepfer et al. | 439/736 |
| 5,494,457 | A | 2/1996 | Kunz | 439/447 |
| 5,538,438 | A | 7/1996 | Orlando | 439/344 |
| 5,562,475 | A | 10/1996 | Kern, Jr. et al. | 439/344 |
| 5,600,885 | A | 2/1997 | Schroepfer et al. | 29/883 |
| 5,620,335 | A | 4/1997 | Siemon | 439/491 |
| 5,638,474 | A | 6/1997 | Lampert et al. | 385/78 |
| 5,672,071 | A * | 9/1997 | Ceru | 439/353 |
| 5,685,736 | A | 11/1997 | Lung | 439/447 |
| 5,727,962 | A | 3/1998 | Caveney et al. | 439/344 |
| D402,266 | S | 12/1998 | Siemon et al. | D13/156 |
| 5,893,771 | A | 4/1999 | Kern, Jr. et al. | 439/344 |
| 5,993,237 | A | 11/1999 | Kern, Jr. et al. | 439/344 |
| D420,329 | S | 2/2000 | Lin et al. | D13/147 |
| 6,080,001 | A | 6/2000 | Wong | 439/344 |
| 6,174,190 | B1 | 1/2001 | Tharp et al. | 439/352 |
| 6,196,733 | B1 | 3/2001 | Wild | 385/86 |
| 6,210,200 | B1 | 4/2001 | Kranzdorf | 439/344 |
| 6,250,817 | B1 | 6/2001 | Lampert et al. | 385/56 |
| 6,250,949 | B1 | 6/2001 | Lin | 439/418 |
| 6,254,418 | B1 | 7/2001 | Tharp et al. | 439/352 |
| 6,322,386 | B1 | 11/2001 | Tharp et al. | 439/344 |
| D466,479 | S | 12/2002 | Pein et al. | D13/147 |
| 7,101,212 | B1 | 9/2006 | Larkin | 439/334 |
| 2005/0054230 | A1 | 3/2005 | Huang | 439/344 |

FOREIGN PATENT DOCUMENTS

DE 20 2004 019 870 U1 3/2005

* cited by examiner

*Primary Examiner*—Alexander Gilman
(74) *Attorney, Agent, or Firm*—Stallman & Pollock LLP

(57) ABSTRACT

A boot with a flexible actuator can be used to provide improved protection and ease of use for an electrical connector plug. The plug, such as an RJ45 plug connected to a data or communications cable, can have an extended latch member adapted to releasably engage a connection mechanism of a receptacle into which the plug is placed. A recess in a receiving portion of an actuator can capture the extended end of the latch member, whereby damage to the latch member due to snagging or catching on nearby objects is prevented.

19 Claims, 6 Drawing Sheets

*-Prior Art-*

*-Prior Art-*

*-Prior Art-*

*-Prior Art-*

*-Prior Art-*

*-Prior Art-*

*-Prior Art-*

SNAGLESS PLUG AND BOOT CONNECTION

PRIORITY

This application claims priority to U.S. Provisional Application Ser. No. 60/922,101, filed Apr. 6, 2007, the disclosure of which is incorporated herein by reference.

TECHNICAL FIELD OF THE INVENTION

The present invention relates to electrical connections and cable assemblies useful in telecommunications and data transfer applications.

BACKGROUND

When making an electrical connection for a communications cable, a plug 100 attached to an end of the cable 102 as shown in FIG. 1 is shaped to be received by, and held in, an appropriate receptacle in order to establish the connection. The plug typically has a main body portion 104 that is at least partially received by the receptacle (not shown). The plug typically also has a resiliently flexible latch member 106 extending from the main body portion 104. The latch 106 extends at an angle relative to the body, such that as the plug is inserted into the receptacle, the extended end of the latch is forced toward the main body portion. The latch typically is thinner at the extended end than at the end connected to the main body portion, such that when the plug 100 is inserted a proper distance into the receptacle, the thin portion of the latch member 106 can fit through a recess area in the receptacle such that the latch member can "snap" into place as the extended end of the latch member springs away from the main body portion 104. The recess in the receptacle is shaped in such a way that the thicker portion of the latch member cannot pass back through the recess once the latch is snapped in place, thereby holding the plug in place within the receptacle. Mechanisms and recesses for providing this latch/receptacle connection are well known in the art and are not described in detail herein. The extended end of the latch member extends a distance outside the receptacle such that a user can dislodge the plug from the receptacle by "squeezing" the extended end of the latch toward the main body portion, whereby the thicker end of the latch is pushed away from, and/or out of, the recess area and the plug can be removed from the receptacle. This connection approach is commonly used for telephones and telephone cords, as well as for computers and data cables, such as those which adhere to the common cable standards such as RJ45 and RJ11 as known in the art.

One problem with such a latch member, which typically is a thin piece of plastic attached to the main body portion, is that the latch member can easily be snapped off the main body portion. For example, it may be necessary when running a communications cable to pull the cord through a wall or behind office furniture. It is not uncommon for the latch member to "snag" or catch on an object or obstruction during such a pull, whereby the latch member can be broken from the plug.

A number of approaches have been taken to prevent damage to the latch member. In one approach, the main body 104 of the plug is formed with peaks or wing members 108 as shown in FIG. 1 that extend at least as far as the latch member 106. These peaks then will prevent the vast majority of these obstructions from engaging and/or damaging the latch member. While this approach may be acceptable for new runs of cable, it cannot easily be used to upgrade or retrofit existing runs as it is necessary to replace the housing of each plug with a housing that includes the wing members.

In another, more common approach a "boot" 208 or overmold housing is provided that extends over a portion of the communications cable 202, or is part of the exterior of the communications cable, further extending over a portion of the main body 204 and latch member 206 of the plug 200, as shown in FIG. 2. A boot 208 can provide strain relief for the plug/cable connection, and can insulate the electrical connection, as known in the art. The interior of a boot, or at least that portion of the boot that contacts the cable, can adhere to an external surface of the cable, preferably without any air pockets, surface features, or voids that can lessen the strength of the connection. The boot can be made of a plastic, rubber, or polymer material, typically having a rounded, flexible hood portion 210 covering the extended end of the latch member 206 such that the extended end is prevented from snagging on any obstructions. In order for the hood portion to sufficiently protect the latch member, however, it is necessary for the hood material to be relatively rigid in order to provide a certain strength of protection. This rigidity, however, can make it somewhat difficult for a user to squeeze the hood portion 210 in order to depress the latch member 206 and release the plug 200 from the receptacle (not shown).

In yet another approach, a boot is used that does not include a hood portion as in FIG. 2, but instead includes extended wing members similar to those described with respect to FIG. 1. This approach allows the wings to be added to any existing plug simply by placing a boot over plug/cable interface. A downside with such an approach, however, is that it can be difficult for a user to sufficiently depress the latch member, as the size of one of the user's fingers is typically larger than the space between the wing members in which the latch member resides. In addition, the latch member is still vulnerable to breakage.

DETAILED DESCRIPTION

Systems and methods in accordance with embodiments of the present invention can overcome various deficiencies in existing communication connections by providing an improved electrical connector capable of protecting a latching member of the connector while allowing for easy actuation of the latch member by a user.

FIGS. 3 to 6 represent a connector embodiment with improved performance over the devices discussed above. This connector of FIGS. 3 to 6 is the subject of U.S. Pat. No. 7,101,212, which is incorporated herein by reference. FIG. 7, discussed below, represents an improvement in the design described in the latter patent.

Figure 1:
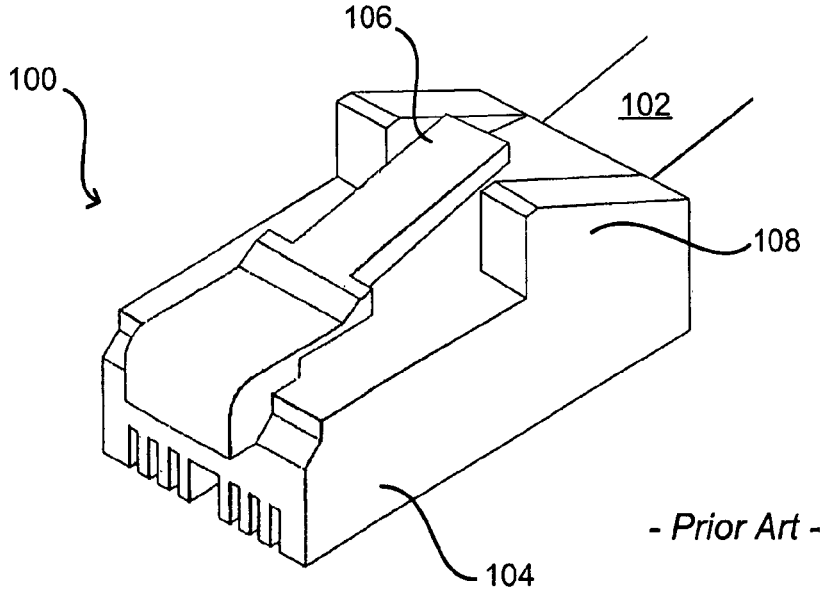
FIG. 1 is a perspective view of a plug connector of the prior art.
Figure 2:
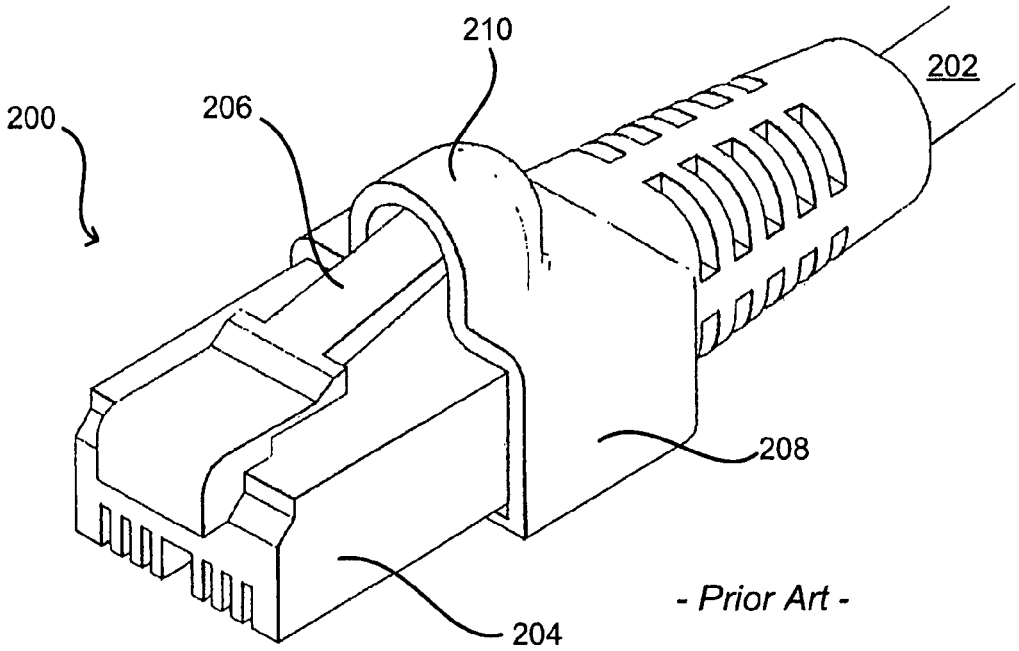
FIG. 2 is a perspective view of a plug connector and boot of the prior art.
Figure 3A:
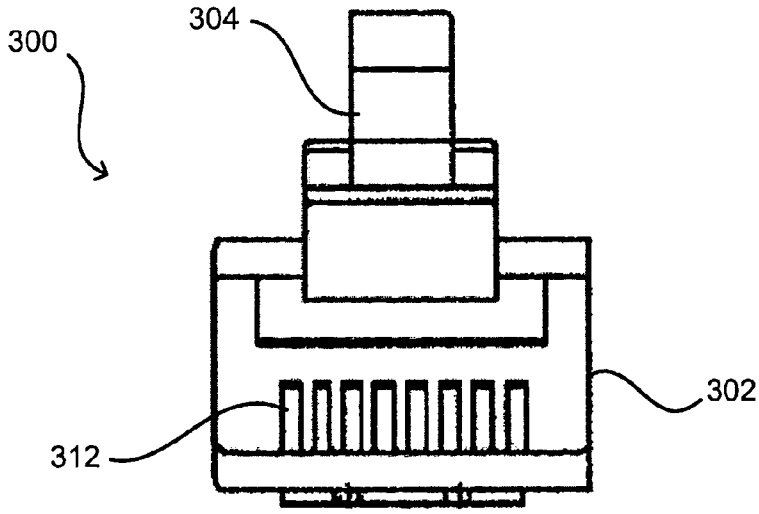
FIG. 3 is (a) and end view and (b) a side view of a plug connector of the prior art.
Figure 3B:
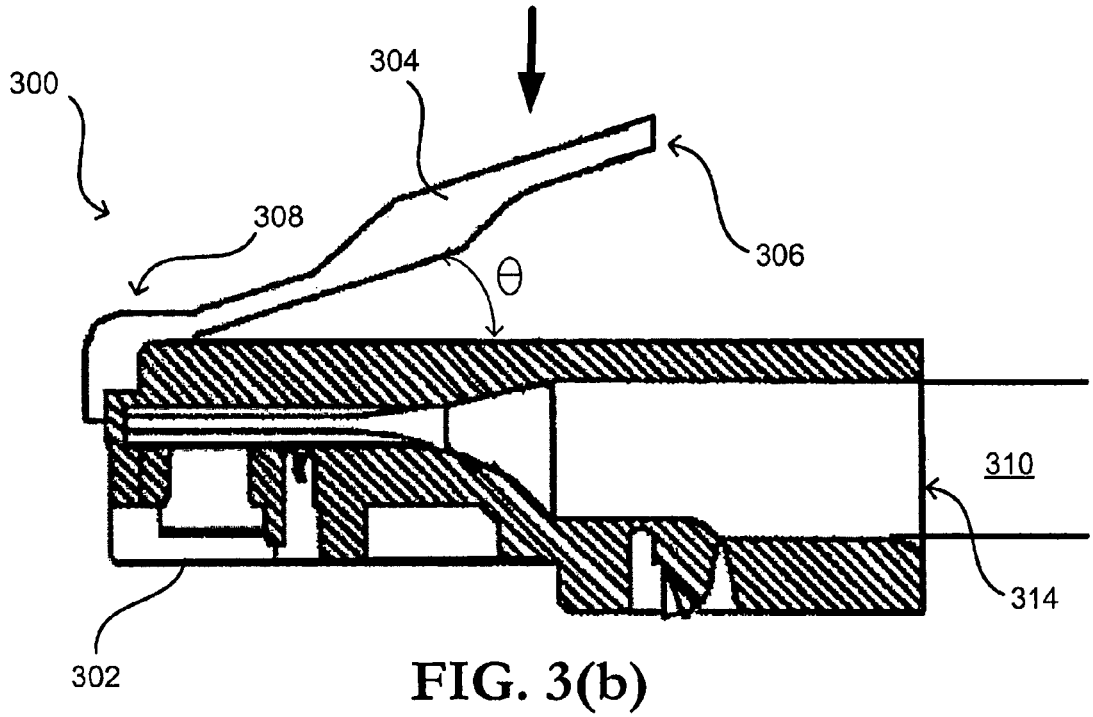

An exemplary electrical connector plug 300 for terminating a communications cable in accordance with one embodiment is shown in FIG. 3. The plug includes a main body portion 302 and an angled, resilient latch member 304. The resilient latch member is attached to the main body portion at a flexure point 308, and has an extended end 306 that extends away from the main body 302. The latch member can be moved upon manual actuation, such as when a user applies a force to the latch member in a direction similar to that indicated by the arrow in FIG. 3(*b*). The latch member can be integral with the body portion, and can be fabricated from any suitable material such as a substantially rigid plastic. It should be understood that the latch member can be a portion of the molded plug, of sufficient thickness at the flexure point to allow for a flexing of the extended end of the latch member toward the main body portion, and not a separately created piece. The latch member 304 can be shaped to have a thinner extended portion, such as described above, to releasably connect the plug 300 to an appropriate connecting member in a receptacle (not shown) when the plug is sufficiently pressed into the receptacle. The resiliently flexible design of the latch member also can allow the latch member to be biased to an initial angular position θ relative to the plug body 302, such that the latch member 304 tends to spring back to that initial position upon removal of the plug from the receptacle, as well as upon proper connection placement of the plug relative to the receptacle, whereby the latch member can snap into place relative to the connection member of the receptacle to hold the plug in place until subsequent disengagement by a user.

The main body 302 has an opening 314 at a first end for receiving a portion of a communications cable 310 or cord, or at least the wires or other communication means therein. The opening can be large enough to accept the cable 310 and any insulation or outer layer of the cable. The main body also has at least one opening 312 at a second end, namely the operable end of the plug that will be received by an appropriate receptacle. An appropriate receptacle will have a cavity therein for receiving at least a portion of the plug at the operable end. The opening(s) at the second end of the plug can be of sufficient dimension to allow each of the individual wires of the communications cable to pass to the operable opening(s), typically in a linear array configuration as known in the art. The exposed ends of the wires then can be connected to, or placed in contact with, corresponding electrical contacts formed in the opening(s) 312 at the operable end of the plug. These electrical contacts can be used to provide electrical connections to the appropriate pads, wires, pins, or contacts of an appropriate communications receptacle.

Figure 4A:
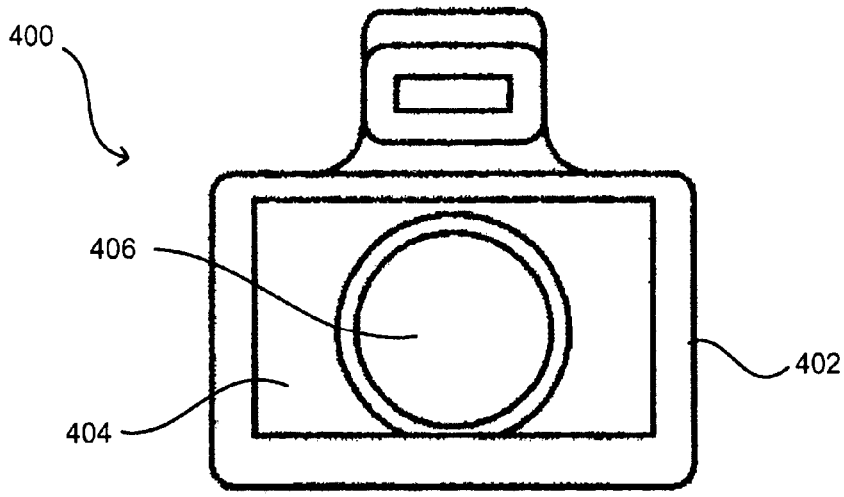
FIG. 4 is (a) an end view and (b) a side view of a prior art boot that can be used with the plug connector of FIG. 3.
Figure 4B:
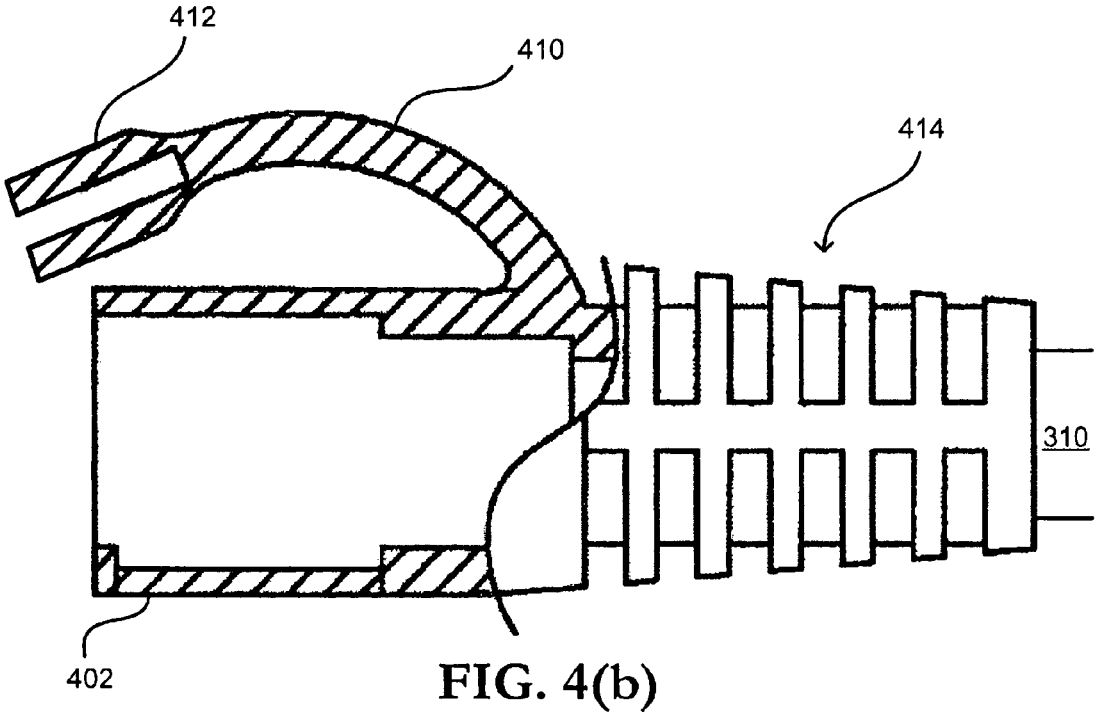
Figure 5A:
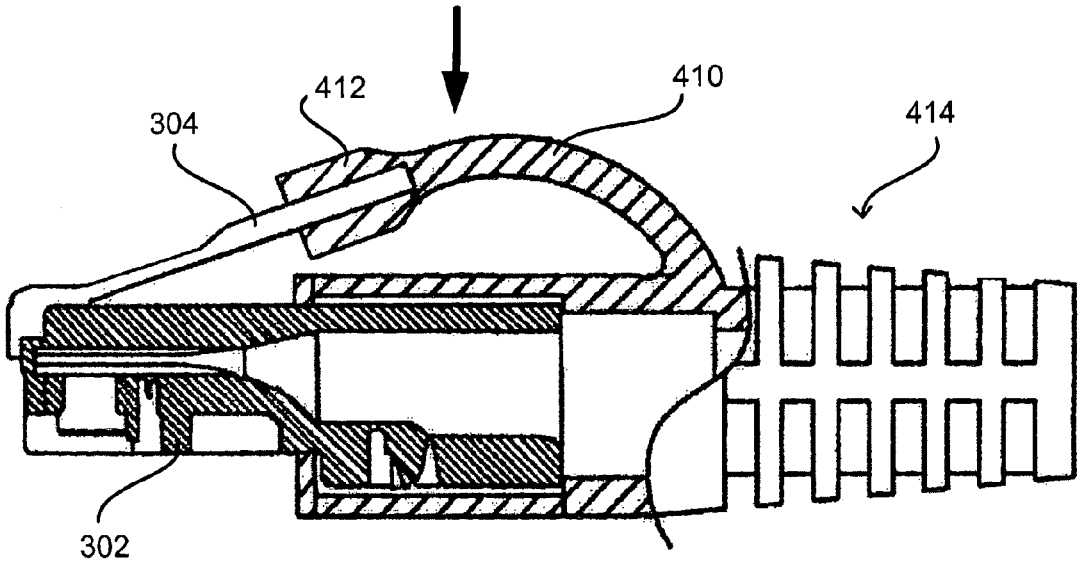
FIG. 5 is (a) a side view and (b) a perspective view of the prior art interconnected plug and boot of FIGS. 3 and 4.
Figure 5B:
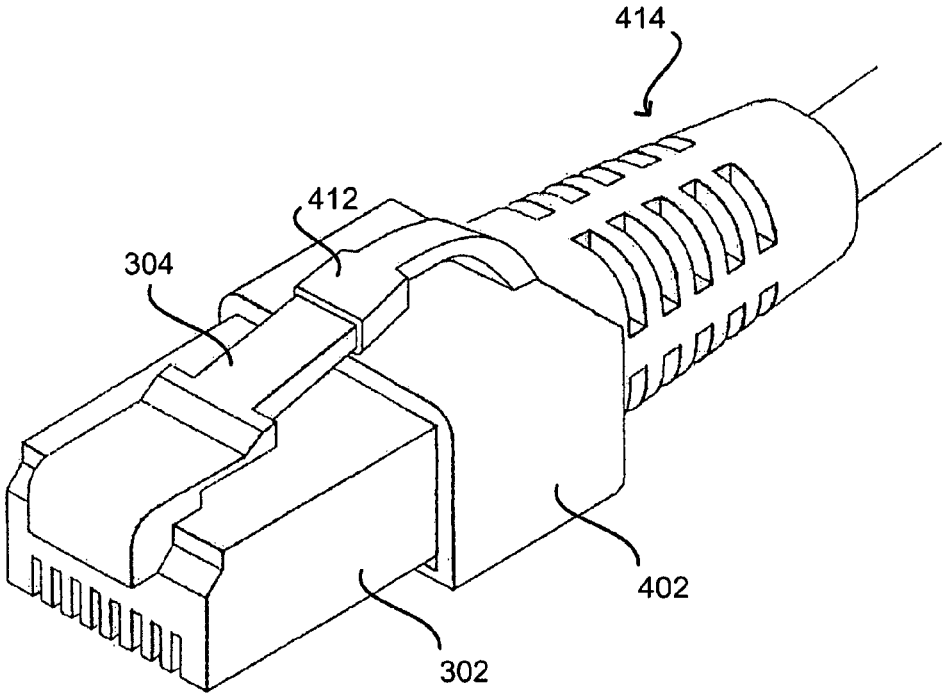

An exemplary boot 400 that can be used with the plug of FIG. 3 in accordance with one embodiment of the present invention is shown in FIG. 4. Reference numbers are carried over between Figures where appropriate, for simplicity. The boot can be made of any appropriate material, such as for example a molded plastic or rubber. In some embodiments, the boot is preferably formed from an insulating material capable of electrically insulating the wires inside the cable and/or plug. The material in one embodiment should be flexible enough to allow proper fitting relative to the plug, while also providing a relatively slip-free grip on the boot. The material also can avoid the presence of air gaps or voids between the plug and the boot where possible, which could otherwise lessen the grip of the boot. The boot includes a housing portion 402, which can have four walls and a back panel 404. The back panel 404 includes an opening 406 of sufficient dimension to allow and end of a communications cable 408, or at least the wires contained therein, to pass through. Although opening 406 is shown as round, other shapes, such as rectangular, can be used to accommodate the shape of the cable. It can be preferable for the opening 406 to be of approximately the same diameter as the diameter of the cable, in order to provide gripping strength and to prevent contaminants, liquids, or electrical charges from entering the boot. This opening also allows the boot 400 to be placed at least partially over the cable and slid into an operable position against the plug connector 300. The four walls of the housing can form a rectangular opening opposite the back panel 404, of sufficient dimension to allow an appropriate plug to slide into the interior of the boot. In another embodiment, a front panel can be provided which includes the rectangular or other appropriately shaped opening for receiving the plug.

A resiliently flexible, arcuate actuator 410 can be attached to, or molded as part of, the exterior of one of the boot walls. The actuator 410 can have a substantially rounded shape extending away from the boot, or can have any other relatively smooth shape that will resist snagging when brought against an obstruction. The extended end of the actuator 410 can include a receiving portion 412 having an opening shaped to slidably receive the extended end of a latch member for a plug contained at least partially within the plug housing 402. The latch member of the plug also can be shaped to easily be received by the receiving portion. The receiving portion 412 or extended end of the latch member 304 can have a bump or ridge shaped to fit into a groove, recess, or hole of the other member in order to allow the extended end to snap into place when inserted into the receiving portion. The interaction between the extended end of a latch member 304 and the receiving portion 412 of the plug actuator 410 can be seen in FIG. 5. The flexible actuator 410, when the receiving portion 412 has an extended end of a plug latch therein, allows a user to simply squeeze the flexible actuator with respect to the plug body, in a motion similar to that shown by the arrow in FIG. 5, whereby the latch member of the plug can be released from a corresponding receptacle as discussed above. The flexible actuator can be flexible enough to provide an ease of motion for a user, while having sufficient strength to prevent damage to the actuator 410 and/or latch member 304 due to obstructions and/or objects coming into contact therewith. The actuator 410 can be formed of a material that can restore its shape after depression or deflection by a user. A benefit to such an actuator is that the actuator functions as an extension to the latch member, making it easier for a user to depress the latch mechanism in order to remove the plug from the receptacle. The actuator has an advantage over a longer latch mechanism, however, in that the smooth shape and receiving portion of the actuator, in addition to the fact that the actuator provides a connection point at the opposite end of the latch member, prevent the latch member from catching or snagging on surrounding objects. Simply extending the latch member would increase the likelihood of snagging and damage to the latch member.

The boot 400 also can utilize a strain relief component 414 as known and used in the art. The strain relief component can be integral with the boot housing, or can be a separate piece that is brought into contact with, and connected or adhered to, the boot housing and/or the plug connector. The strain relief component can strengthen the connection between the communication cable 310 and the plug connector 300. The component also can allow for a bending of the cable without applying any appreciable bending force to either the plug or the boot. The strain relief component can be any appropriate strain relief component known or used in the art, including a passage to receive the communication cable 310. The strain relief component 414 also can have a number of ribs and/or grooves on the external surface, which can increase the flexibility of the component while maintaining strength and ability to absorb bending forces.

The boot housing 402 can be made of at least two portions in one embodiment, allowing the boot to be attached to the plug and/or cable without having to slip the boot over an end of the cable and/or remove the plug from the cable for retrofit applications. For instance, a boot (which can include an integrated strain relief component and/or actuator) can include a top half and a bottom half that are adhered, bolted, snapped together, screwed together, or otherwise connected to one another once in place relative to at least one of a cable and plug connector.

The boot housing also can be colored, or can have a symbol or description formed therein, which can allow the attached cable to be identified relative to other cables and/or cords positioned around the connector. Appropriate coloration and/or coding also allows the proper connector to easily be placed in the appropriate receptacle.

Figure 6:
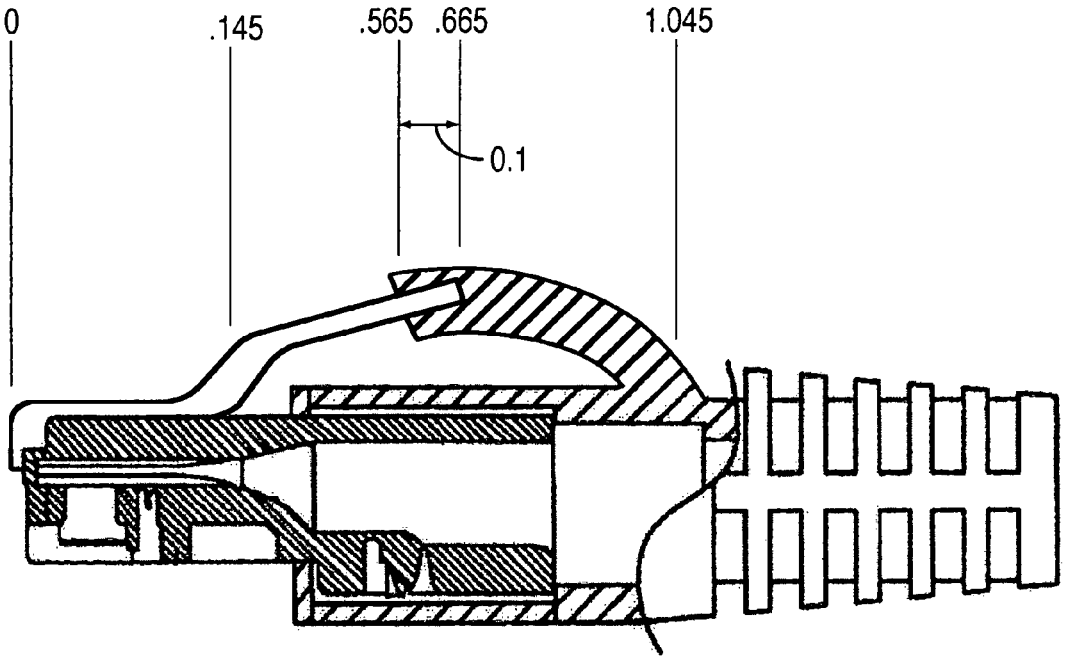
FIG. 6 is a side, cross sectional view of a prior art plug connector and boot.
Figure 7:
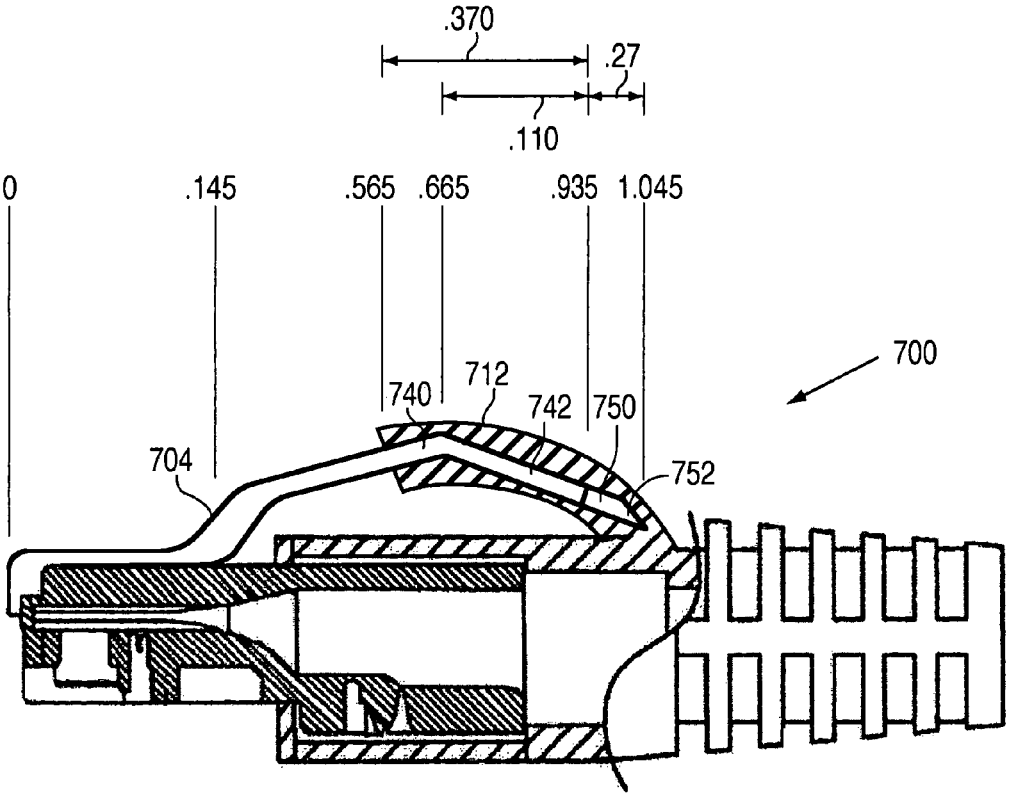
FIG. 7 is a side, cross sectional view of a plug connector and boot in accordance with the subject invention.

FIG. 6 is a cross sectional view of the prior art connector provided to better illustrate the differences between the prior art and the modified connector of the subject invention which is shown in FIG. 7. Except as discussed below, the connectors in FIG. 6 and FIG. 7 are the same.

In the embodiment of FIG. 7, the connector 700 includes a latch 704. Latch 704 includes a short forward portion 740 which is similar to the portion of the latch 412 which is captured in the actuator of the prior art connector of FIG. 6. In a preferred embodiment, the length of forward portion 740 is 0.1 inches.

In accordance with the subject invention, latch 704 further includes a rearward portion 742 which substantially extends into the actuator 712. In the illustrated embodiment, the rearward portion 742 is 0.27 inches long. In combination, the front and rearward portions of the latch 704 extend into the actuator much farther than in the prior art connector. In a preferred embodiment, the total length of the latch portion captured by the actuator is preferably at least 0.25 inches, is more preferably at least 0.30 inches and even more preferably 0.35 inches in length. In a prototype design, the total length of the latch captured by the actuator was 0.370 inches in length.

Preferably, the latch extends into the actuator by at least two thirds of the length of the actuator. In the illustrated embodiment, the latch extends into the actuator about three-quarters of the length of the actuator (0.370/0.480 inches). Preferably, the length of rearward portion 742 of the latch is at least as long as the forward portion and is preferably at least twice as long.

As seen in FIG. 7, the forward portion 740 of the latch extends upwardly away from the body as in the prior art connector. However, the rearward portion 742 of the latch is configured to bend back down towards the body. In a preferred embodiment, the latch is formed with a kink or dogleg at the juncture between the forward portion 740 and the rearward portion 742. Alternatively, the latch needs only to be sufficiently flexible so that when it is inserted into the actuator, the rearward portion will bend downwardly back towards the body of the connector.

Actuator 712 is provided with a recess 750 which is significantly longer than in the prior art connector. In the preferred embodiment, the recess 750 includes a space 752 located beyond the end of the latch when the latch is in the rest position. By this arrangement, when the actuator is pressed downwardly, the free end of the latch will slide further into the recess. This configuration reduces the amount of pressure needed to depress the actuator. In the illustrated embodiment, the length of space 752 is about 0.110 inches.

It has been found that by substantially increasing the length of the latch captured by the actuator performance is enhanced. More specifically, the added length provides more leverage so that it is easier to flex the latch by pressing on the actuator. In addition, this structure provides improved strength and resists breakage from side to side motions.

It should be recognized that a number of variations of the above-identified embodiments will be obvious to one of ordinary skill in the art in view of the foregoing description. Accordingly, the invention is not to be limited by those specific embodiments and methods of the present invention shown and described herein. Rather, the scope of the invention is to be defined by the following claims and their equivalents.

I claim:

1. A connector for a communications cable, comprising:

a plug having a body portion for receiving an end of the communications cable, the plug further having a resilient latch member attached to the outer surface of the body portion, the resilient latch member extending away from the body portion at an angle and having an extended end opposite the body portion; and a boot having a housing portion for receiving the body portion of the plug and the end of the communications cable, the boot further having a flexible arcuate actuator attached to the outer surface of the housing portion, the flexible actuator having a receiving portion at the end opposite the housing portion that has an elongated recess shaped to receive and capture the extended end of the resilient latch member and wherein the length of the extended end captured within the recess of the actuator is at least 0.25 inches, whereby movement of the flexible actuator toward the housing causes a movement of the resilient latch member toward the body portion of the plug.

2. A connector as recited in claim 1, wherein the length of the extended end captured within the recess of the actuator is at least 0.30 inches.

3. A connector as recited in claim 1, wherein the length of the recess is sufficient to allow the end of the latch member to slide within the recess when the actuator is flexed towards the housing.

4. A connector as recited in claim 1, wherein the extended end of the resilient latch member has a generally rectangular cross section and the recess of the arcuate actuator includes a rectangular opening for receiving and securing said extended end of the resilient latch member.

5. A connector as recited in claim 1, wherein the extended end of the resilient latch member captured within the actuator includes forward portion that extends away from the body and a rearward portion that bends downwardly back towards the body portion.

6. A connector as recited in claim 5, wherein the rearward portion of the latch member is at least twice as long as the forward portion.

7. A connector for terminating a communication cable, comprising:

a plug for receiving the cable through a rear end thereof, a front end of the plug including slots for receiving and supporting one or more wires carried by the communication cable, the plug further including an elongated, resilient latch member having a first end being attached near the front end of the plug and a second end extending upwardly at an angle and towards the rear end of the plug; and a boot having a housing into which a portion of the rear end of the plug is received with the communication cable passing through the housing, the boot further including a resilient arcuate actuator having one end thereof being connected to the housing and the other end including a recess for receiving and capturing said second end of the resilient latch member and wherein the length of the second end of the latch member that is captured within the recess of the actuator is at least 0.25 inches such that when the actuator is depressed the latch will also be depressed.

8. A connector as recited in claim 7, wherein the length of the extended end captured within the recess of the actuator is at least 0.030 inches.

9. A connector as recited in claim 7, wherein the length of the recess in the actuator is sufficient to allow the end of the latch member to slide within the recess when the actuator is flexed towards the housing.

10. A connector according to claim 7, wherein the second end of the resilient latch member has a generally rectangular cross section and the recess of the arcuate actuator includes a rectangular opening for receiving and securing said second end of the resilient latch member.

11. A connector as recited in claim 7, wherein the extended end of the resilient latch member captured within the actuator includes forward portion that extends away from the body and a rearward portion that bends downwardly back towards the body portion.

12. A connector as recited in claim 11, wherein the rearward portion of the latch member is at least twice as long as the forward portion.

13. A connector for a communications cable, comprising:

a plug having a body portion for receiving an end of the communications cable, the plug further having a resilient latch member attached to the outer surface of the body portion, the resilient latch member extending away from the body portion at an angle and having an extended end opposite the body portion, said extended end including an intermediate portion and a rearward portion which is angled downwardly back towards the body portion; and a boot having a housing portion for receiving the body portion of the plug and the end of the communications cable, the boot further having a flexible arcuate actuator attached to the outer surface of the housing portion, the flexible actuator having a receiving portion at the end opposite the housing portion that has an elongated recess shaped to receive and capture the intermediate and rearward portions of the resilient latch member and wherein the length of the extended end of the latch member captured within the recess of the actuator is sufficient to extend at least two thirds of the way into the actuator, whereby movement of the flexible actuator toward the housing causes a movement of the resilient latch member toward the body portion of the plug.

14. A connector as recited in claim 13, wherein the length of the extended end captured within the recess of the actuator is at least 0.035 inches.

15. A connector as recited in claim 13, wherein the rearward portion of the latch member is at least twice as long as the intermediate portion.

16. A connector for a communications cable, comprising:

a plug having a body portion for receiving an end of the communications cable, the plug further having a resilient latch member attached to the outer surface of the body portion, the resilient latch member extending away from the body portion at an angle and having an extended end opposite the body portion, said extended end including an intermediate portion and a rearward portion which is angled downwardly back towards the body portion, wherein the rearward portion is longer than the intermediate portion; and a boot having a housing portion for receiving the body portion of the plug and the end of the communications cable, the boot further having a flexible arcuate actuator attached to the outer surface of the housing portion, the flexible actuator having a receiving portion at the end opposite the housing portion that has an elongated recess shaped to receive and capture the intermediate and rearward portions of the resilient latch member whereby movement of the flexible actuator toward the housing causes a movement of the resilient latch member toward the body portion of the plug.

17. A connector as recited in claim 16, wherein the length of the extended end captured within the recess of the actuator is at least 0.035 inches.

18. A connector as recited in claim 16, wherein the rearward portion of the latch member is at least twice as long as the intermediate portion.

19. A connector as recited in claim 16, wherein the length of the extended end captured within the recess of the actuator is sufficient to extend at least two thirds of the way into the actuator.

* * * * *